United States Patent [19]

Tkach et al.

[11] Patent Number: 4,733,731

[45] Date of Patent: Mar. 29, 1988

[54] AIR-OPERATED REVERSIBLE PERCUSSIVE ACTION MACHINE

[76] Inventors: Khaim B. Tkach, ulitsa Frunze, 67, kv. 272; Alexandr D. Kostylev, ulitsa Derzhavina, I9, kv. 70; Konstantin K. Tupitsyn, ulitsa Frunze, 57a, kv. II5, all of Novosibirsk; Mikhail J. Bondar, ulitsa Zhukovskogo, 23a, kv. 4, Odessa; Vladimir I. Tarasenko, ulitsa Gaidara, 22, kv. 26, Odessa; Igor I. Reznikov, Proletarsky bulvar, I4, kv. 23, Odessa, all of U.S.S.R.

[21] Appl. No.: 844,177

[22] PCT Filed: Jun. 20, 1985

[86] PCT No.: PCT/SU85/00049

§ 371 Date: Feb. 10, 1986

§ 102(e) Date: Feb. 10, 1986

[87] PCT Pub. No.: WO86/00357

PCT Pub. Date: Jan. 16, 1986

[30] Foreign Application Priority Data

Jun. 20, 1984 [SU] U.S.S.R. ..... 3790258

[51] Int. Cl.[4] ..... B25D 9/00

[52] U.S. Cl. ..... 173/91; 175/19

[58] Field of Search ..... 173/91, 135, 116; 175/19

[56] References Cited

U.S. PATENT DOCUMENTS

| | | | |
|---|---|---|---|
| 3,727,701 | 4/1973 | Sudnishnirov et al. | 173/91 |
| 3,891,036 | 6/1975 | Schmidt | 173/91 |
| 4,078,619 | 3/1978 | Sudnishnikov et al. | 173/91 |
| 4,221,157 | 9/1980 | Schmidt | 173/91 |

FOREIGN PATENT DOCUMENTS

| | | |
|---|---|---|
| 2722297 | 12/1980 | Fed. Rep. of Germany . |
| 238424 | 9/1969 | U.S.S.R. . |
| 630361 | 9/1978 | U.S.S.R. . |
| 652279 | 3/1979 | U.S.S.R. . |
| 1139808 | 2/1985 | U.S.S.R. . |

*Primary Examiner*—E. R. Kazenske
*Assistant Examiner*—Hien H. Phan
*Attorney, Agent, or Firm*—Burgess, Ryan & Wayne

[57] ABSTRACT

An air-operated reversible percussive action machine comprises a housing (1) accommodating a reciprocating hammer (2). Secured inside the housing (1) is a stepped tube (5). The step of larger diameter of the tube (5) is received by a cavity (4) of the hammer (2) and has a port (12) for distributing air flow and feeding it to the interior of the housing (1). The tube (5) receives a sleeve (14) having a port (15) alternately communicable with the port (12) of the tube (5) in one of its two positions. One end face of the tube (5) has a projection (13) in the form of a sector of a circle, whereas the sleeve (14) is provided with a radial projection (16) so that in turning the sleeve (14) its projection (16) bears on one of the side walls of the projection (13) of the sleeve (5) thus assuming one of the two positions.

3 Claims, 11 Drawing Figures

AIR-OPERATED REVERSIBLE PERCUSSIVE ACTION MACHINE

FIELD OF THE INVENTION

This invention relates to civil engineering, and more particularly to an air-operated reversible percusive action machine which can find application, for example, in making holes in the ground, and driving into the ground various structural elements, such as pipes.

A special feature of such machines is the provision of a means for reversing its percussive action to retrieve the machines from a blind hole made in the ground or disconnect the percussive action part from the element being driven into the ground.

BACKGROUND OF THE INVENTION

There is known an air-operated percussive action machine (cf., USSR Inventor's Certificate No. 238,424, IPC E 02f 5/18) comprising a cylindrical housing, a hammer having a port and a cavity in its tail portion, a threaded air distribution tube, and a nut provided with passages.

The air distribution tube occupying the interior of the hammer is of stepped configuration. End face edges of the larger step act to control air distribution, i.e., time the inlet of compressed air to the return stroke chamber of the hammer and discharge thereof to the outside. The step of smaller diameter has a threaded portion to connect the air distribution tube to the housing of the machine. By unscrewing the tube from the housing the end face edges of the larger diameter step are displaced to ensure an advance inlet of compressed air to the return stroke chamber, whereby inpacts of the hammer on the front portion of the housing are prevented. Conversely, a delayed exhaust of compressed air causes a longer stroke of the hammer, whereby the impacts are delivered on the rear portion of the housing for the machine to operate in the reverse percussive action mode.

In order to change the percussive action of the machine, it is necessary to stop the delivery of compressed air and screw the tube into the housing. The end face edges of the larger diameter step are therefore moved forward to cause a delayed (as compared with the reverse percussive action) inlet of compressed air to the front working chamber and advanced exhaust thereof to the outside. This determines operation of the machine in the forward percussive action mode, when the impacts are delivered exclusively on the front end of the housing.

The abovedescribed arrangement of the percussive action machine suffers from the following disadvantages:

(a) much time required for switching the machine over from one percussive action mode to the other, since such a procedure involves terminating the supply of compressed air, disconnecting the air-feeding hoses, and turning the tube 10 to 14 revolutions, or repeating these procedures in the reverse successive when changing the percussive action of the machine from the forward to the return travel in the hole;

(b) affected reliability in operation due to that one of the elements of the machine structure, particularly the tube, extends away from the housing, whereby dirt is liabile to plug the threads and jam the machine; and (c) excessive amount of manual labour for changing the percussive action mode of the machine.

There is also known an air-operated reversible percussive action machine (cf., West German Pat. No. 2,340,751; IPC E 21b 7/00) comprising a housing, a hammer having a port and a cavity in its tail portion to reciprocate inside the housing, a tube having projections and recesses provided at the step of smaller diameter and secured at a flange provided with a hole and grooves, and a lock means with a cable. For reversing the percussive action of the machine it is sufficient to pull the cable, release the lock means, and then to turn the tube so that its projections would align with the grooves of the flange, whereby under the action of compressed air the tube enters the grooves by moving axially.

However, the above arrangement of the machine suffers from a number of disadvantages, among which are;

(a) complicated percussive action reversal procedure due to simultaneously applying a pull force to the cable for releasing the lock means and rotating the air-feeding hose; two attendants being needed for this operation;

(b) failure to effect a remote control switching from the rearward to the forward percussive action;

(c) impossibility of changing the percussive action mode without terminating the supply of compressed air;

(d) overcomplicated construction;

(e) low operation reliability due to the necessity of an additional means for locking the hammer, which is susceptible to jamming; and (f) inapplicability in machines of small radial dimensions.

There is further known a percussive action machine (cf., West German Pat. No. 2,105,229; C1. E 02 D 17/146) comprising a cylindrical housing accommodating a reciprocable hammer having a cavity and a port in its tail portion to receive a tube with two rows of holes on its side wall, the interior of the tube being provided with a rotatable rod member having shaped grooves to close or open the ports of the tube. The steps of smaller diameter of the tube sleeve accommodate a pin and a shaped groove. A spring is interposed between the tube and rod member.

In order to reverse the percussive action of the machine (change its operating mode), it is necessary to shut off the delivery of compressed air and reapply the air after a while. Under the action of the spring the rod member is caused to move forward, whereas, the shaped groove of the tube, cooperates with the pin of the rod member to turn the latter. Compressed air admitted to the machine acts to move the rod member rearwards resulting in its turning: after making two revolutions the rod member assumes a new position in which other ports axially offset to the rear of the tube relative to the first group of ports will open (thus closing the first group of ports). This results in a delayed discharge of compressed air from the front working chamber, whereby the machine moves rearwards. For changing the machine operation from the reverse to the forward percussive action the aforedescribed procedures are repeated.

Again, such an arrangement evidence the following disadvantages:

(a) inconveniences in handling because the attendant is not aware of the exact positions assumed by machine parts after stopping; failure to reverse the percussive action of the machine without shutting off the flow of compressed air; each termination of the flow of compressed air to the machine causes a reversal in its percussive action;

(b) insufficient safety when starting to drive the machine into the ground; this is firstly due to the fact that the machine may start with the reverse percussive action to injure the attendant, and secondly a termination in the delivery of compressed air to the machine causes it to reverse, again subjecting the operator to danger;

(c) structural complication necessitated by the fabrication of the shaped groove, such grooves being impossible to make in machines of small diameter; and (d) low energy of impacts due to the provision of a plurality of ports on the step of larger diameter of the tube requiring an elongated tube and thus reducing the stroke length of the hammer, also overcomplicating the machine structurally.

SUMMARY OF THE INVENTION

The present invention aims at providing an air-operated reversible percussive action machine in which a locking means for a sleeve which controls the percussive action mode of the machine would be so arranged relative to an air distribution tube as to ensure reliable functioning of the machine in the forward and reverse travel operations and convenient switching from one to the other percussive action mode.

The essence of the invention resides in the fact that in an air-operated reversible percussive action machine comprising a housing with front and rear portions accommodating a reciprocating hammer provided with a cavity and a port through which the cavity of the hammer communicates with a chamber of the housing, the rear portion of the housing having secured therein a stepped tube, the larger diameter step of this tube having a port and being accommodated in the cavity of the hammer so as to alternately close the port of the hammer and communicate it with its own port, the interior of the tube accommodating a sleeve having a port communicable with a compressed air line and capable of turning relative to the tube to assume two positions in one of which it closes the port of the tube, while in the other it communicates the port of the tube with the compressed air line through its port, according to the invention, one of the end faces of the larger diameter step of the tube is provided with at least one projection (first projection) in the form of a sector of a circle, whereas the sleeve is provided with at least one radial projection arranged on its respective end so that when the sleeve is turned its projection is thrust against one of side walls of the first projection of the tube thus assuming one of its two positions.

The above arrangement is simple and more reliable, because the turnable element, viz. the sleeve, has two set positions determining the forward and rearward percussive action of the machine, whereas few structural parts (the tube and the sleeve) make the percussive action more dependable.

Preferably, the first projection of the tube is disposed at the free end of the tube's larger step, whereas the projection of the sleeve is provided at the sleeve's adjacent free end.

Such an arrangement simplifies fabrication and facilitates a more reliable operation, because projections are amenable to machining, and they take up only the forces associated with turning of the sleeve relative to the tube.

It is advisable that the end face of the larger diameter step of the tube be provided with at least one additional sector-like elongated projection circumferentially spaced from the first projection, the first projection having a length greater than the length of the additional projection, the sleeve being capable of axial movement relative to the tube for a distance which is longer than the length of the additional projection and shorter than the length of the first projection.

This is advantageous, because self-induced reversal is obviated, since the sleeve is locked against rotation by virtue of the fact that its radial projection is interposed between the first and additional projections of the tube, which in turn adds to the general reliability of the machine in operation.

It is further preferable that the side faces of the first and additional projections of the tube and those of the projection of the sleeve be at an angle to each other with the apex of the angle thus formed facing the rear portion of the housing, these side faces of the projections of the tube and those of the projection of the sleeve mating with each other.

Arrangement of the percussive action machine in the above manner enables one to lock the sleeve relative to the tube to result in greater reliability. It further increases the area of contact between the projections of the tube and sleeve still more enhancing the reliability and increasing the service life. Also, a more accurate alignment of the ports of the tube and those of the sleeve relative to each other is facilitated.

Advantageously, the sleeve is provided with at least one longitudinal groove communicating with the compressed air line and having secured therein an elastic element completely covering this groove, which ensures locking of the sleeve relative to the tube during the forward and rearward percussive action travel of the machine thanks to the alignment of their ports.

The longitudinal grooves are preferably dove-tailed in cross-section.

This provides pressure-sealing of the cavity under the elastic element when the latter is raised by compressed air to result in a greater force applied for locking the sleeve against turning, eventually making the machine more reliable in operation.

Preferably, provided in the body of the sleeve is at least one cylindrical cavity opening on the outside with the axis thereof extending perpendicularly to the longitudinal axis of the sleeve, this cavity accommodating a piston and communicating with the compressed air line.

The above makes it possible to ensure a more reliable locking of the sleeve relative to the tube both in the forward and rearward percussive action modes of the machine, especially in winter time, when the elastic elements tend to lose their elastic property.

Advisably, the sleeve is spring-loaded relative to the tube so that the projections of the sleeve and tube are continuously urged to each other.

This enables to make use of the spring for imparting tension to the sleeve and ensuring a continuous contact of its projection with the tube making the operation of the machine more reliable while preventing inadvertent reversals.

BRIEF DESCRIPTION OF THE DRAWINGS

The invention will now be described in greater detail with reference to various specific embodiments thereof taken in conjunction with the accompanying drawings, in which.

BEST MODE OF CARRYING OUT THE INVENTION

Figure 1:
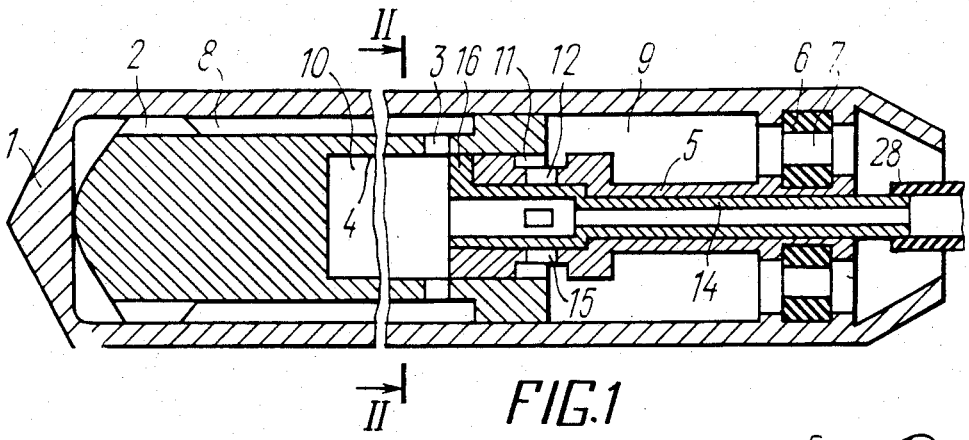
FIG. 1 is a longitudinal sectional view of an air-operated reversiable percussive action machine according to the invention showing parts thereof in positions for the forward travel of the machine.

The percussive action machine embodying the present invention comprises a housing 1, which accommodates a reciprocating hammer 2 having a port 3 and a cavity 4 in its tail portion receiving a stepped tube 5 secured by means of an elastic shock-absorber 6 in the housing 1. The shock-absorber 6 has a passage 7 for discharging the spent air. The hammer 2 separates the interior of the housing 1 into two chambers 8 and 9, of which chamber 8 serves for ensuring a return stroke of the hammer 2, whereas the other chamber 9 serves for discharging compressed air from the chamber 8. The hammer 2 defines with the tube 5 a chamber 10 which ensures a forward stroke of the hammer 2. At its step of larger diameter the tube 5 has an annular recess 11 with a port 12, whereas at the side of the front end the tube 5 is provided with a first annular elongated projection 13 (FIG. 2) having the form of a sector of a circle. Inside the tube 5 is a stepped sleeve 14 (FIG. 1) having a port 15 at its larger step and an annular radial projection 16 (FIG. 3) at the side of the front end of the step of larger diameter. The radial projection 16 of the sleeve 14 occupies a space between end faces 17, 18 (FIGS. 2 and 3) of the first annular elongated projecting 13 of the tube 5.

Figure 8:
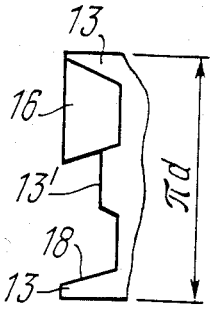
FIG. 8 is a development on the diameter d.

With reference to FIG. 8, there may be several such annular elongated projections 13 at the step of larger diameter of the tube 5, such as two such projections 13 and 13'; their end faces being preferably inclined to each other so that the thus formed angle could face by its vertex the rear portion of the machine. In this case a spring 19 (FIG. 4) is preferably arranged between the tube 5 (FIG. 1) and sleeve 14 to move the sleeve 14 (FIG. 1) toward the working chamber 10. Provided at the sleeve 14 are two longitudinal grooves 20 (FIGS. 4 and 5) connected by way of a port 21 to the air feeding line. These grooves 20 accommodate elastic elements 22.

Figure 6:
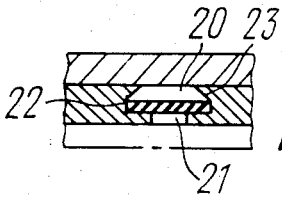
FIG. 6 is an enlarged view of section A in FIG. 4.
Figure 9:
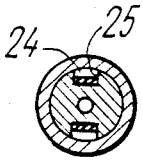
FIG. 9 is a section taken along the line IX—IX in FIG. 7.

The outer portion of the longitudinal groove 20 can have the form of a dove tail 23 (FIG. 6). The step of smaller diameter of the sleeve 14 (FIG. 7) can be provided with a cylindrical cavity 25 communicating through the port 21 with the air feeding line, this cavity 25 accommodating a piston 24 (FIG. 9).

When arranging a spring 26 (FIG. 10) in the tail portion between the tube 5 and nut 27 which holds an air feeding hose 28 and sleeve 14, the projections 16 of the sleeve 14 are continously in contact with the tube 5. Therewith, the side faces 17, 18 (FIG. 11) of the large projection 13 run in parallel with the longitudinal axis of the machine.

In order to ensure reliable operation of the proposed reversible percussive action machine, it is sufficient to provide one radial projection 16 (FIG. 4) in the sleeve 14 and one longitudinal projection 13 (FIG. 2) in the sleeve 5. However, an alternative embodiment of the proposed machine envisages projection 13 and 16 on the tube 5 and sleeve 14, respectively, symmetrically arranged relative to the longitudinal axis of the machine.

It is to be noted that a directly opposite arrangement is possible, where the longitudinal projection 13 is provided on the sleeve 14, whereas the radial projection 16 is provided on the tube 5. In such a case the projection 16 extends toward the longitudinal axis of the sleeve (tube). In principle, this second embodiment is substantially identical to the aforedescribed one.

When compressed air is admitted along the nose 28 (FIG. 1) to the chamber 10 and is conveyed through the port 3 of the hammer 2 to the reverse stroke chamber 8 of the hammer 2, the latter is caused to move rearwards by virture of a difference between the surfaces areas of the hammer 2 at the sides of the chambers 10 and 8. As soon as the port 3 of the hammer 2 moves beyond the rear end of the step of larger diameter of the tube 5, compressed air is discharged from the chamber 8 through the port 3 of the hammer 2 to the chamber 9 to escape via the passage 7 of the shock absorber 6 to the outside. The pressure of air in the chamber 8 becomes equal to the atmospheric, and due to the action of compressed air present in the chamber 10 the hammer 2 is caused to move forward to deliver impacts on the front portion of the housing 1. The aforedescribed cycle is then repeated.

In order to reverse the percussive action of the machine, it is necessary to turn the sleeve 14 a halfturn. In consequence, the radial projection 16 of the sleeve 14 is brought into contact with the end face 18 (FIG. 2) of the elongated annular sector (projection) 13 of the tube 5. The port 15 (FIG. 1) of the sleeve 14 is aligned with the port 12 of the tube 5. Compressed air is admitted to the chamber 8 through the respective ports 15 and 12 of the sleeve 14 and tube 5, annular recess 11 of the tube 5 and port 3 of the hammer 2. Admission of compressed air to the chamber 8 occurs earlier in time to prevent an impact from being delivered on the front portion of the housing 1. Because the volume of chamber 8 is greater, the hammer 2 is accelerated more vigorously to result in an impact delivered thereby on the rear portion of the housing 1. Discharge of compressed air from the chamber 8 also occurs after the port 3 of the hammer 2 moves beyond the rear end face of the tube 5. After compressed air is discharged from the chamber 8, the pressure of air in the chamber 10 makes the hammer 2 move forward. In the reverse travel operation mode this cycle is repeated. For switching the operation of the machine from the reverse to forward percussive action mode of operation it is necessary to turn the sleeve 14 to the opposite side until its radial projection 16 is thrust against the end face 17 of the elongated annular projection 13 of the tube 5. Therewith, the port 12 of the tube 5 is closed by the step of larger diameter of the sleeve 14 for air to be distributed by the front and rear end edges of the larger diameter step of the tube 5, whereby the machine will operate in the aforedescribed forward percussive action mode.

In order to retain the sleeve 14 in a position for the forward or backward percussive action mode, the hose 28 (FIG. 1) is twisted so as to make the radial projection 16 of the sleeve bear against one of the end faces 17, 18 of the elongated annular projection 13 of the tube 5. The annular recess 11 is necessary in order to ensure that during turning of the hammer 2 compressed air is admitted from the port 12 of the tube 5 to the port 3 of the hammer 2.

With reference to FIGS. 4 to 11, modifications of the proposed machine represented therein prevent inadvertent reversal of its percussive action.

Figure 4:
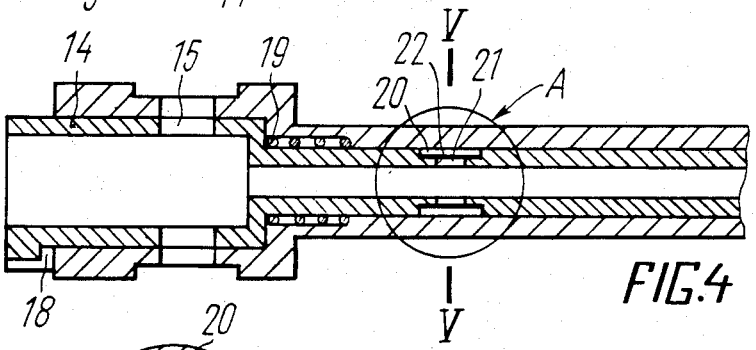
FIG. 4 illustrates the position of the sleeve and tube during the rearward percussive action of the machine according to the invention.

In the case represented in FIG. 4 compressed air is admitted to the machine after turning the sleeve 14. Through the port 21 of the sleeve 14 the air enters under the elastic element 22 to flow to the elongated groove 20. The elastic element 22 is forced to the wall of the tube 5 thus ensuring that the sleeve 14 is prevented from turning. For pressure-sealing the elongated groove 20 its outer surface 23 (FIG. 6) is fashioned as a dove tail. Here, the elastic element 22 tends to press by its peripheral surfaces to the levels of the dove tail. The central part of the elastic element 22 curves to be thrust against the inner surface of the tube 5, whereby a force is provided capable of preventing the sleeve 14 from being turned relative to the tube 5.

Figure 7:
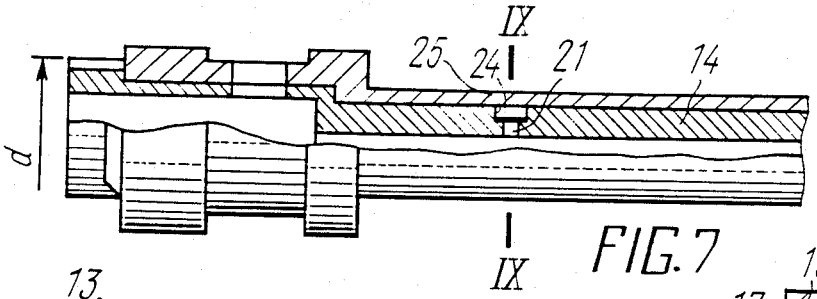
FIG. 7 is a modified form of the tube with two projections.

The modification illustrated in FIGS. 7 and 8 is more complicated in fabrication, although more reliable in operation.

A distinctive feature of this modification is the provision of two elongated annular projections 13 and 13' at the large diameter step of the tube 5.

The projection 13 of the tube 5 is intended to limit the turning angle of the sleeve 14 controlling the distribution of air, whereas the additional projection 13' serves for locking the sleeve 14 against rotation relative to the tube 5. The end faces of these projections 13, 13' are preferably inclined to each other so that the vertex of the angle formed thereby would face the rear section of the machine.

Under the action of compressed air the sleeve 14 is locked by its radial projection 16 in one of positions between the projections 13, 13' of the tube 5, the inclined end faces of the projections of the tube 5 and sleeve 14 ensuring their accurate alignment with the longitudinal axis. On the one hand, this prevents the sleeve 14 from turning relative to the tube 5 (i.e., obviates knocking of parts), whereas on the other hand, it ensures a more accurate mutual positioning of the ports 15 and 12 of the sleeve 14 and tube 5.

Figure 11:
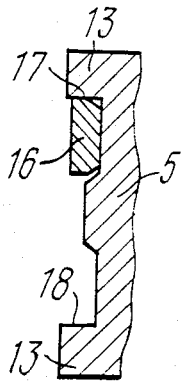
FIG. 11 is a development of the diameter on the projections of the tube and sleeve.

The side faces 17, 18 of the projection 13 of the tube 5 can run parallel with the longitudinal axis of the machine as represented in FIG. 11. This modified form is simpler to construct; another advantage being a greater bearing on the contact surfaces of the sleeve 14 and tube 5 resulting eventually in a more reliable operation of the machine.

It has to be noted that with a symmetrical structure featuring two pairs of radial projections on the sleeve and on the tube spaced relative to the longitudinal axis of the machine, two additional projections are provided on the tube 5. Normally, the number of additional projections on the tube 5 must correspond to the number of radial projections on the sleeve 14.

In order to reverse the percussive action of the machine, it is necessary to move the sleeve 14 forward to a length of the first longitudinal projection 13. With the provision of rigid air-feeding hoses and small hole length this operation can be effected by simply pushing the hose forward. Alternatively, use can be made of the spring 19 (FIG. 4) which would act to move the sleeve 14 when the supply of compressed air is terminated. It should be remarked here that after application of compressed air the hoses tend to shorten by 10–15%, depending on their rigidity. Therefore, termination of the delivery of compressed air would result in the hose moving the sleeve 14 to a length of the elongated additional projection 13' of the tube 5, which amounts to between 7 and 10 mm. Thereafter, by rotating the hose the sleeve 14 is turned until its radial projection 16 is in contact with the end face of the elongated projection 13. After reapplying compressed air the sleeve 14 moves rearwards and its radial projection 16 assumes a position between the elongated projections 13, 13' of the tube 5 bearing on the end face 17 of the projection 13, which causes the machine to operate in the forward percussive operation mode.

For reversing the machine operation it is necessary to terminate the supply of compressed air, whereby the projection 16 of the sleeve 14 moves after the elongated additional projection 13' of the tube 5. Then having turned the sleeve 14 in the opposite direction, compressed air is reapplied to make the radial projection 16 of the sleeve 14 assume a position between the elongated projections 13, 13' of the tube 5 bearing on the end face 18 of the projection 13 of the tube 5 to result in the reverse percussive action of the machine.

One of the projections 13 of the tube 5 is preferably longer than the other projection 13' to prevent excessive turning of the sleeve 14 relative to the tube 5.

FIGS. 7 and 9 illustrate one more modified form of locking the sleeve 14 relative to the tube 5 by means of the piston 24 (for the sake of reducing the number of drawings this modification is shown in a drawing where use is made of other methods of locking, viz., by means of two projections; one of the modifications will be materialized in real machine construction). Compressed air is admitted through the hole 21 to under the piston 24 to raise this piston 24 and press it to the inner surface of the tube 5. The cylindrical cavity 25 corresponds to the diameter of the piston 24. In winter conditions, when the elastic elements tend to become rigid, such a construction ensures more reliable locking.

Figure 2:
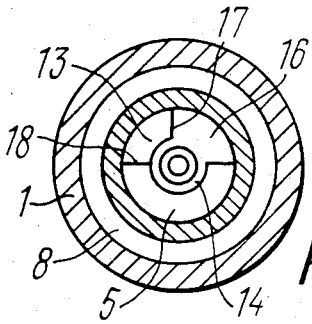
FIG. 2 is a section taken along the line II—II in FIG. 1.

For changing the percussive action mode it is necessary to terminate the supply of compressed air and rotate the hose 28 (FIG. 1). The piston 24 (FIG. 7) is sunk in the cylindrical cavity 25, the sleeve 14 is forced forward by the hose 28 (or, alternatively, use is made for the purpose of the spring 19 interposed between the tube 5 and sleeve 14) and turned until it is in contact with the side surface 18 of the projection 13 of the tube 5. A repeated switchover of the percussive action operation mode of the machine is effected in a reverse sequence.

Figure 3:
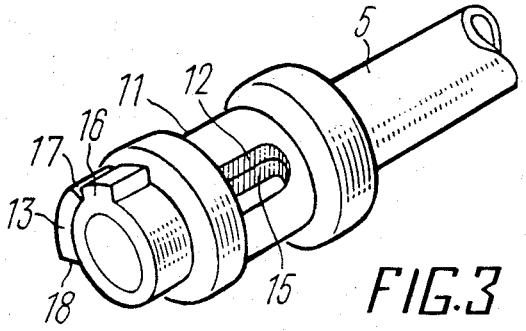
FIG. 3 is an axonometric view of the front portion of the tube and sleeve.
Figure 5:
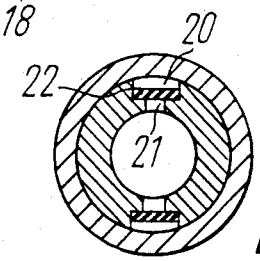
FIG. 5 is a section taken along the line V—V in FIG. 3.

It is important to note that the modification with reference to FIG. 7 (provided with a piston) is easier to fabricate; however, the other embodiment (featuring an elastic element) shown in FIGS. 3 to 5 ensures a greater force thanks to an increased friction coefficient. The optimized version is selected depending on the conditions of operation.

Figure 10:
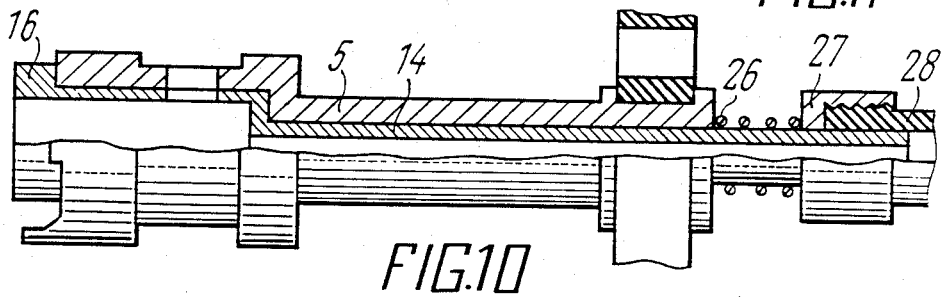
FIG. 10 shows a modified form of an air distribution assembly with a spring.

With reference to FIGS. 10 and 11, in one more modified form of the proposed machine, the tube 5 has two elongated annular sector-like projections 13, 13', whereas the sleeve 14 has a radial annular projection 16. In the tail portion between the tube 5 and nut 27 there is provided a spring 26 by means of which the hose 28 is attached to the sleeve 14. The spring 26 acts to ensure a continuous pressure of the projection 16 of the sleeve 14 to the tube 5. When compressed air is admitted, the pressure is enhanced to prevent inadvertent change in the percussive operating modes of the machine.

In order to change the percussive action mode of the machine, the supply of compressed air is terminated and the sleeve 14 is turned by rotating the hose 28. Thanks to the inclined side faces of the projections 13, 13', as well as those of the tube 5, projection 16 and sleeve 14, the sleeve 14 climbs onto the projection 13' of the tube 5 to compress the spring 26, whereby during a further rotation of the hose 28 it is locked in a position corresponding to the rearward travel of the machine. A subsequent switchover is done in a reverse succession. In this case the spring 26 is used for locking the sleeve 14 relative to the tube 5.

Such a construction ensures that the sleeve 14 is continuously urged to the tube 5 and that both elements are locked for a desired percussive action mode of operation of the proposed machine. Accidental interruption in the supply of compressed air (or reduction in the pressure of air in the air feeding line) does not cause inadvertent reversal, or self-induced switchover in the percussive action mode of operation of the macine, thanks to the compression spring 26 interposed between the rear end of the tube 5 and nut 27 by which the hose 28 is secured to the sleeve 14.

Two alternatives are possible when the spring 19 is arranged to bear on the rear end face of the larger diameter step of the sleeve 14 (FIG. 4). By the use of a compression spring as seen best in FIG. 4, after terminating the supply of compressed air, the sleeve 14 tends to move forward by the force of such spring, and the percussive action mode of the machine can be changed by turning the sleeve 14.

However, when the delivery of compressed air is accidentally stopped, or when the pressure of air in the air-feeding line drops to such an extent that the force of the spring 19 exceeds the force of compressed air, the sleeve 14 is liable to move relative the tube 5 to result in possible self-induced reversal of the machine, such as with the air feeding hose twisted excessively to this or that side.

Conversely, when making use in the modification shown in FIG. 4 of a tension spring, no inadvertent switchover occurs (the machine operates substantially as described with reference to FIG. 10 employing a compression spring). In this case it is necessary, however, that the side faces of the projections 13, 13' and 16 of the tube 5 and sleeve 14, respectively, be preferably provided with bevels (FIG. 11) of a less pronounced slope angle ensuring the movement of the projection 16 of the sleeve 14 on the additional projection 13' having in lengthwise section a length less than the length of the main projection 13.

The heretofore described modified forms of the proposed machine (featuring a compression or tension spring and having a corresponding arrangement of the side faces of the projections of the tube and sleeve) have their own optimum application.

For preventing inadvertent self-reversals the modification shown in FIG. 10 is most preferable. When using rigid air-feeding hoses and small-diameter machines, it is advisable to materialize the embodiment represented in FIG. 4, because the probability of self-induced reversals due to pinched hoses or reduced air pressure in the air-feeding line is negligible.

The selection of optimized modification of the machine from among those proposed in the description depends on the conditions in which the machine is supposed to operate.

INDUSTRIAL APPLICABILITY

This invention relates to the art of civil engineering to find application in percussive action machines for making holes in the ground, and driving into the ground structural elements, such as pipes and piles, etc.

The use of various features of the invention makes it possible to increase the reliability of reversible percussive action machines, reduce the number of parts, simplify the machines structurally, as well as to make the machines serve longer.

The proposed invention is multipurpose in the sense that the small radial dimensions enable its application in percussive action machines of modest cross section. As to machines of larger radial dimensions, it can be used as successfully as any other prior art device. Otherwise stated, it offers a wider range of industrial applications than the prior art machines. By way of example, the proposed invention provides reversibility to a percussive action machine having a housing of less than 40 mm across. No technical solutions competing with the proposed one have hitherto been known.

We claim:

1. An air-operated reversible percussive action machine predominantly for making holes in the ground, comprising:

a housing having front and rear portions;

a reciprocating hammer positioned in the housing and provided with a cavity and a first port through which the cavity communicates with a chamber of the housing;

a stepped tube secured to the rear portion of the housing and having an interior, the stepped tube having a larger diameter step with a second port and an end face at a free end of said tube, the larger diameter step being positioned in the cavity of the hammer so as to alternately close the first port of the hammer and provide communication with the second port;

a sleeve positioned within the interior of the tube, the sleeve having a third port communicable with a compressed air line, the sleeve being capable of turning relative to the tube to assume one of two positions, in one of which the second port of the tube is closed, and in the other position, the second port of the tube communicates with the compressed air line through the third port;

at least one first projection in the form of a sector of a circle formed on the end face of the larger diameter step;

at least one radial projection arranged on a respective end of the sleeve so as to abut against a side wall of said at least one first projection of the tube when the sleeve is rotated, whereby said sleeve-assumes one of said two positions;

at least one additional annular elongated projection provided about the circumference on the end face of the larger diameter step and spaced from the at least one first projection; and the at least one first projection having a length greater than the length of the at least one additional projection, wherein the sleeve is capable of moving relative to the tube in an axial direction thereof for a distance greater than the length of the at least one additional projection and less than the length of the at least one first projection.

2. A percussive action machine as claimed in claim 1, wherein said at least one first projection, said at least one additional projection and said at least one radial projection have side faces formed at an angle to each other, with a vertex of the angle facing the rear portion of the housing, and the side faces of the at least one first projection and at least one additional projection mating with side faces of said at least one radial projection of the sleeve.

3. A percussive action machine as claimed in claim 2, wherein the sleeve is spring-loaded relative to the tube so that the at least one first projection, at least one additional projection and at least one radial projection are continuously urged against each other.

* * * * *